US005692975A

United States Patent [19]

Hesse

[11] Patent Number: 5,692,975

[45] Date of Patent: Dec. 2, 1997

[54] SOCCER TRAINING AID

[76] Inventor: Michael L. Hesse, 627 Chatsworth Rd., Tabernacle, N.J. 08088

[21] Appl. No.: 722,392

[22] Filed: Sep. 30, 1996

[51] Int. Cl.[6] ..... A63B 69/00

[52] U.S. Cl. ..... 473/426

[58] Field of Search ..... 273/413, 414, 273/58 C, 26 E; 473/139, 147, 423, 426, 471; 482/89

[56] References Cited

U.S. PATENT DOCUMENTS

| | | | |
|---|---|---|---|
| 708,573 | 9/1902 | Miles | 482/89 |
| 3,042,401 | 7/1962 | Denegre | 273/26 E |
| 3,227,450 | 1/1966 | Pruitt | 273/58 C X |
| 4,966,367 | 10/1990 | Oyarzabal | 273/26 E |
| 5,280,922 | 1/1994 | Jones | 273/413 X |

*Primary Examiner*—William H. Grieb
*Attorney, Agent, or Firm*—Rosenblatt & Redano P.C.

[57] ABSTRACT

A soccer training aid which allows the user to continuously kick a tethered ball at a variety of angles. This embodiment allows the user to focus on developing leg strength and ball control without having to pursue the ball or the encumbrance of a hand-held control utilized in returning the ball.

13 Claims, 1 Drawing Sheet

SOCCER TRAINING AID

FIELD OF THE INVENTION

The present invention relates to soccer training aids which are used in building leg strength and developing ball control.

BACKGROUND OF THE INVENTION

Known training aids allow for only a single spring return mechanism which is restricted by a hand held controller used to control the maximum distance the ball will be propelled. This is disadvantageous because the user must concentrate on maintaining control of the hand held controller while attempting to kick the ball. It is an object of this invention to provide an individual with the ability to strengthen his or her legs while practicing different basic kicks without the requirement of a hand held device used to control the return of the ball. A preferred embodiment of this invention utilizes a plurality of elastic cables which allow for limited propulsion at a variety of angles.

SUMMARY OF THE INVENTION

A soccer training aid which allows the user to continuously kick a tethered ball at a variety of angles. This embodiment allows the user to focus on developing leg strength and ball control without having to pursue the ball or the encumbrance of a hand-held control utilized in returning the ball.

DETAILED DESCRIPTION OF THE PREFERRED EMBODIMENT

Figure 1:
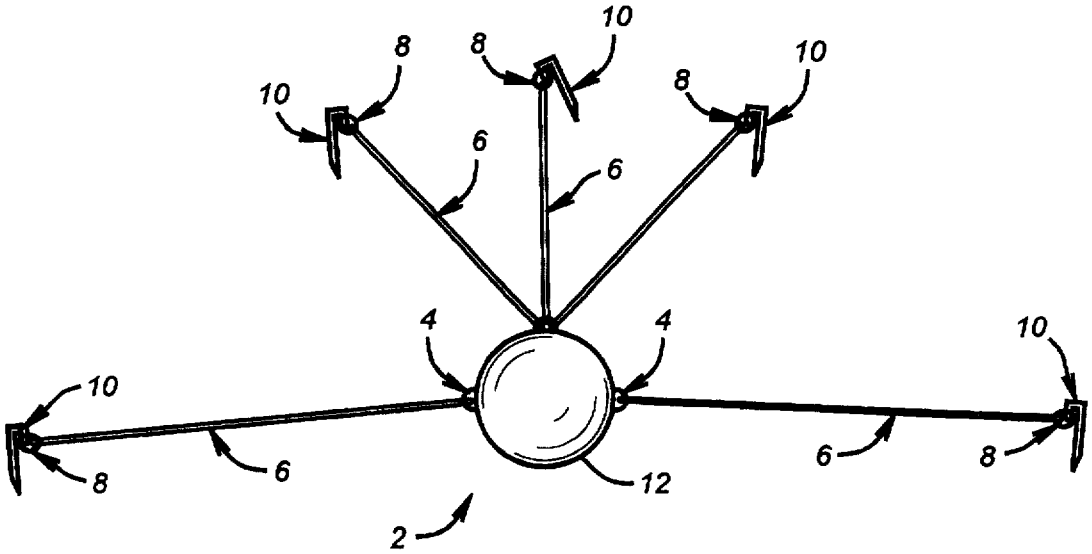
FIG. 1 is a perspective view of the soccer training aid.

In accordance with the present invention, a soccer ball is supported within a ball retainer 2, comprising an open network of interlacing cords which accepts the ball and secures it as illustrated in FIG. 1. The ball retainer 2 contains three oval shaped connectors 4. One end of each connector 4 is attached to the ball retainer 2 while the other end is connected to a cable 6 preferably made of rubber or an equivalent elastic material. The elastic cables 6 are connected to an oval connector 8 coupled to a stake 10. The stakes 10 are placed into the ground at different angles in respect to the ball retainer 2 and at a distance far enough away from the ball retainer 2 to cause all the elastic cables 6 to be taut. When the ball 12 contained within the retainer 2 is kicked, the force of the kick will place varying degrees of tension on the elastic cables 6 depending on the direction of the force and the placement of the elastic cables 6. Once the momentum of the ball 12 contained within the retainer 2 is halted, the elastic cables 6 will contract and return the ball 12 back to its starting position.

Figure 2:
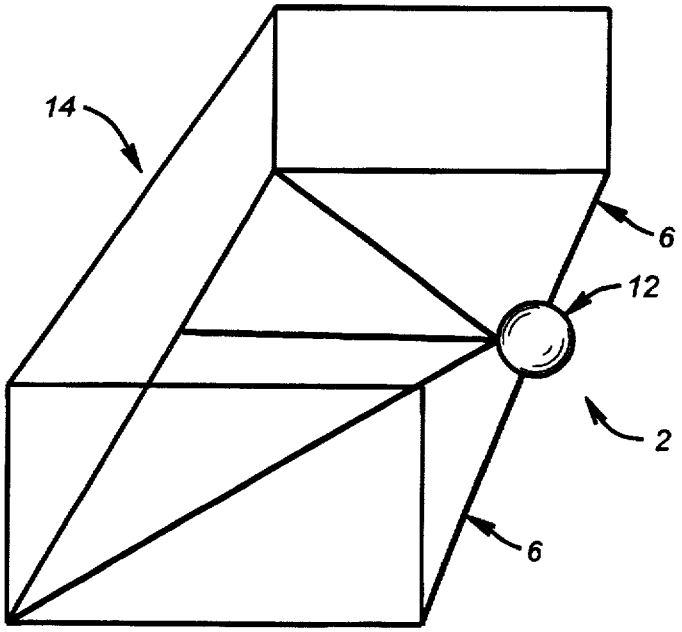
FIG. 2 is a variant of FIG. 1 using a frame for indoor use.

Different techniques for flexibly returning the ball 12 can be used. The number and position of the elastic cables 6 can be varied. The ball 12 may be directly secured to the elastic cables 6. All the elastic cables 6 can be attached to a frame 14 as opposed to stuck in the ground for an indoor application, as illustrated in FIG. 2.

Ball 12 could have various shapes or sizes, i.e. a kick ball, a soccer ball, a football, a rugby ball.

Elastic cables 6 can be initially taut or slack although if they are all initially taut the ball 12 will always return to close to the same spot. In the preferred embodiment two of the cables can be about 180 degrees apart while in between and in an direction opposite the kicker they can be closer together such as 15–30 degrees apart. One elastic cable 6 can be directly opposite the kicker.

All the elastic cables 6 do not necessarily have the same strength. Those elastic cables 6 closest to the kicker can be stronger to resist the kick while those placed opposite the kicker can be weaker.

While several embodiments of the present invention been illustrated in detail, it is apparent that modifications and adaptations of the embodiments shown will occur to those skilled in the art. However, it is to be expressly understood that such modifications and adaptations are within the spirit and scope of the present invention as set forth in the following claims.

What is claimed is:

1. A kicking practice aid for a person kicking a ball, comprising:

a ball retainer for holding the ball during a kick;

plurality of retaining members extending from said ball retainer, said retaining members secured to a support independent of the person kicking a ball and holding said ball retainer in a stationary position prior to a kick;

said retaining members extend radially from said retainer in an array contained within an arc about said ball retainer, wherein two of said retaining members closest to the kicker define said arc;

at least a third said retaining member is located within said arc; and said two retaining members which define said arc are stronger than at least a third said retaining member disposed within said arc.

2. The kicking practice aid in claim 1, wherein said retaining members are elastic.

3. The kicking practice aid in claim 1, wherein said ball retainer comprises a mesh.

4. The kicking practice aid in claim 1, wherein said retaining members extend radially from said retainer in an array contained within about an arc of 180 degrees about said ball retainer.

5. The kicking practice aid in claim 1 wherein said retaining members are affixed to the ground.

6. The kicking practice aid in claim 1, wherein said retaining members are affixed to a frame.

7. The kicking practice aid in claim 1, wherein some said retaining members are more taut then others.

8. A kicking practice aid for a person kicking a ball, comprising:

a ball retainer for holding the ball during a kick;

a plurality of retaining members extending from said ball retainer, said retaining members secured to a support independent of the person kicking a ball and holding said ball retainer in a stationary position prior to a kick;

said ball retainer comprises a mesh;

said retaining members extend radially from said retainer in an array contained within an arc about said ball retainer, wherein two of said retaining members closest to the kicker define said arc;

at least a third said retaining member is located within said arc; and said two retaining members which define said arc are stronger than at least a third said retaining member disposed within said arc.

9. The kicking practice aid in claim 8, wherein said retaining members extend radially from said retainer in an array contained within about an arc of 180 degrees about said ball retainer.

10. The kicking practice aid in claim 9, wherein said retaining members being angularly farthest apart from each other are stronger than other said retaining members angularly closer together.

11. The kicking practice aid in claim 10, wherein said retaining members are affixed to a frame.

12. The kicking practice aid in claim 11, wherein some said retaining members are more taut then others.

13. The kicking practice aid in claim 8, wherein said retaining members are affixed to the ground.

* * * * *